United States Patent [19]

Ohnuma et al.

[11] 4,382,420

[45] May 10, 1983

[54] DEVELOPMENT APPARATUS

[75] Inventors: Teruyuki Ohnuma, Yokohama; Seiichi Miyakawa, Nagareyama; Nobuo Mochizuki, Matsudo; Hajime Oyama, Tokyo; Yukio Tabata, Yokohama, all of Japan

[73] Assignee: Ricoh Company, Ltd., Tokyo, Japan

[21] Appl. No.: 229,165

[22] Filed: Jan. 28, 1981

Related U.S. Application Data

[63] Continuation of Ser. No. 921,972, Jul. 5, 1978, abandoned.

[30] Foreign Application Priority Data

Jul. 7, 1977 [JP] Japan ..... 52/81228
Aug. 19, 1977 [JP] Japan ..... 52/99209

[51] Int. Cl.[3] ..... G03G 15/09; G03G 15/06

[52] U.S. Cl. ..... 118/651; 118/656; 355/3 DD

[58] Field of Search ..... 430/120; 118/651, 656; 355/3 DD

[56] References Cited

U.S. PATENT DOCUMENTS

| | | | |
|---|---|---|---|
| 4,036,175 | 7/1977 | Phillips et al. | 118/651 |
| 4,119,060 | 10/1978 | Mochizuki | 118/651 |
| 4,121,931 | 10/1978 | Nelson | 430/120 |
| 4,194,828 | 3/1980 | Holz et al. | 118/651 |

*Primary Examiner*—John E. Kittle
*Assistant Examiner*—John L. Goodrow
*Attorney, Agent, or Firm*—Henry T. Burke

[57] ABSTRACT

An apparatus for developing a latent electrostatic image formed on a photoconductive recording material in a dry type electrophotographic copying machine typically employing a one-component type developer comprises a conductive electrode held in contact with the developer. The electrode is connected to a power source through a switching device and serves to charge the developer to a predetermined polarity with a predetermined potential before the latent image is developed. In this way, the latent image can be developed selectively as either a normal image or a reverse image quite easily.

25 Claims, 17 Drawing Figures

DEVELOPMENT APPARATUS

This application is a continuation of applicants' copending application Ser. No. 921,972 filed July 5, 1978 and now abandoned.

BACKGROUND OF THE INVENTION

The present invention relates to a development apparatus for developing a latent electrostatic image formed on a photoconductive recording material in a dry type electrophotographic copying machine employing a one-component type developer.

A conventional an apparatus for developing a latent electrostatic image formed on a photoconductor by use of a one-component type developer is disclosed in Japanese laid-open patent application Sho-47-13088 and Japanese patent Sho-51-36070, as well as U.S. Pat. No. 3,731,146.

As shown in FIG. 1, in such development apparatus, a latent electrostatic image formed on a photoconductor drum 1 is developed by a development roller 2 which is rotated in the direction of the arrow. The development roller 2 is made of an elastic conductive material.

The one-component type developer placed in a container 3 adheres to the surface of the development roller 2 and is carried to the photoconductor drum 1. While the developer is carried to the drum 1, the developer is triboelectrically charged by a plurality of triboelectric charging and toner distributing blades 4. The developer exists from under the blades 4 in the form of a thin layer on the surface of the development roller 2. By bringing the thin developer layer into pressure contact with the latent electrostatic image, development is performed. The blades 4 are made of Teflon or Delrin or other appropriate resins.

However, in this development apparatus, since the developer is charged triboelectrically, the development apparatus has the following shortcomings. (1) The developer is not charged speedily; (2) The charging polarity and the potential level of the developer are determined only by the developer and the material of the triboelectric blade so that they cannot be changed readily; and (3) The triboelectric charging blade are worn during use, which results in the triboelectric charging efficiency of the blades being lowered over prolonged use.

Furthermore, in order to allow a negative copy to be made from a positive original or a positive copy to be made from a negative original by use of the conventional development apparatus, two methods can generally be used. One method is to change the polarity of the latent electrostatic image formed on the photoconductor so as to produce the require charge pattern, and the other method is to develop the latent electrostatic image by use of one of two types of developers, each of which is electrically charged to a polarity opposite to that of the other.

In the first method, it is necessary to use two types of photoconductors whose charging polarities are different, or a photoconductor which can be charged to two different polarities. In order to do this, there is a limitation to the kind and the shape of the photoconductor which can be used in this method. Moreover, the polarity of a high voltage generating apparatus for use with a positive or negative corona charger has to be changed, which makes the development apparatus complicated in mechanism and expensive.

In the second method, two types of developers with different polarities have to be used. Thus, in the case of a copying apparatus having only one development apparatus, one developer has to be replaced completely with the other developer whenever the development process is changed. This is greatly time consuming. Further, it is difficult to discharge completely the developer that has been placed in the development apparatus, and when the succeeding developer is mixed with the preceding developer, a background deposition and other troubles are apt to occur. Alternatively a copying machine having two development apparatus can be used and one apparatus would be operated while the other apparatus is unoperated. Providing two development apparatus in one copying machine, however, makes the copying machine over-sized and expensive.

SUMMARY OF THE INVENTION

It is therefore an object of the present invention to provide a development apparatus for developing a latent electrostatic image formed on a photoconductor recording material, capable of charging the developer speedily.

Another object of the invention is to provide a development apparatus capable of changing the charged potential of the developer manually or automatically, whereby a good quality copy can be obtained.

A further object of the invention is to provide a development apparatus capable of obviating the fusing of the developer on the photoconductor recording material.

A further object of the invention is to provide a development apparatus capable of changing the charging polarity of the developer, whereby a copy of a reverse image can be obtained quite simply.

According to one embodiment of the invention, developer is charged to a predetermined polarity by a conductive electrode so that the developer is charged speedily, and a bias voltage is applied to a development roller for developing a latent electrostatic image. In another embodiment of the invention, the conductive electrode for charging the developer to a predetermined polarity also serves as a member regulating the thickness of the developer to form a layer with a predetermined thickness on the development roller. In the above-mentioned embodiments, the respective conductive members are connected to switching means, current control means and appropriate power sources.

In a further embodiment of the invention, instead of the development roller in the above-mentioned embodiment, an endless conductive belt passing over a pair of rollers is employed, and as the conductive electrode, a conductive roller electrode is employed. In addition to the conductive roller electrode, an additional electrode is disposed inside a hopper containing the developer. Furthermore, a counter electrode is disposed at the backside of the endless conductive belt and right under the additional conductive electrode.

In still further embodiments, a polarity switching device for changing the polarity of the charge to be applied to the conductive electrode is additionally connected with the conductive electrode in the above-mentioned first two embodiments.

DETAILED DESCRIPTION OF THE PREFERRED EMBODIMENTS

Figure 1:
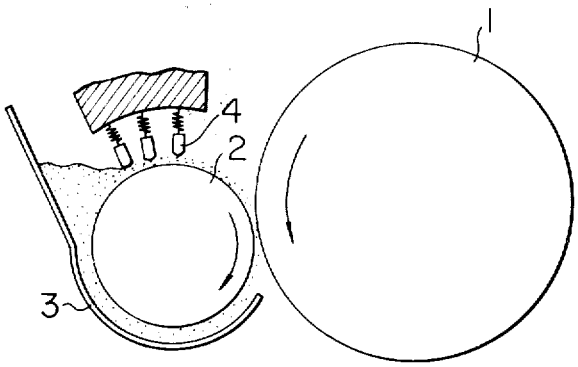
FIG. 1 PRIOR ART
FIG. 1 is a schematic sectional side view of a prior art development apparatus.
Figure 2:
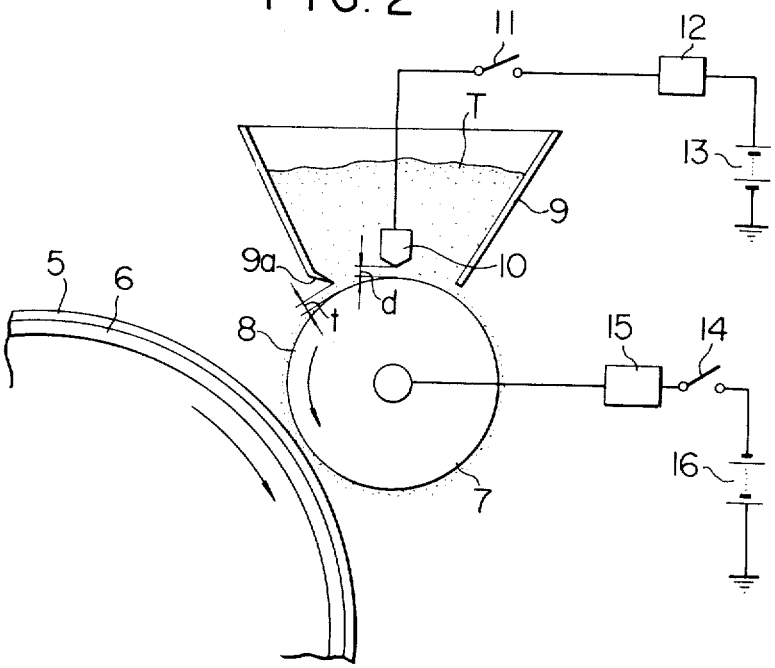
FIG. 2 is a schematic sectional side view of an embodiment of a development apparatus according to the invention.

FIG. 2 is a schematic sectional side view of an embodiment of a development apparatus according to the present invention. In FIG. 2, reference numeral 5 represents a photoconductive material formed on a conductive support member 6 for supporting the photoconductive material 5 thereon, which is rotated in the direction of the arrow at a predetermined speed V. As the photoconductive material 5, Se, Se-Te, ZnO, PVK/TNF, $TiO_2$, CdS and copper-phthalocyanine can be employed. A latent electrostatic image can be formed on the photoconductive material 5 by an ordinary process and other process, such as NP process or KIP process in which a latent electrostatic image is formed on a photoconductive member comprising a conductive substrate, a photoconductive layer formed on the substrate, and a transparent insulating layer formed on the photoconductive layer by applying charges on the photoconductive member by a corona charger or a transparent electrode. The conductive support member 6 may be shaped not only in a drum-like form, but also in a belt-like form. A development roller 7 can be made of a conductive material whose volume resistivity is $10^8$ Ωcm or less, preferably not more than $10^5$ Ωcm and accordingly metals can be employed in the development roller 7. Moreover, a silicone rubber, a chloroprene rubber, and a polyurethane rubber which are made conductive, respectively, can be employed in the development roller 7 and are suitable for transporting a one-component developer (hereinafter called "toner") thereon, since the surface of these materials is suitably elastic to form a toner layer 8 with an appropriate thickness thereon.

Figure 3:
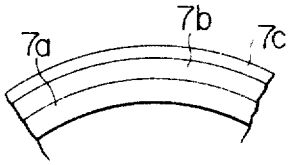
FIG. 3 is a schematic partial sectional view of a development roller to be employed in an embodiment of a development apparatus according to the invention.

As shown in FIG. 3, the development roller 7 can be constructed in multi-layers. Namely, an elastic layer 7*b* is formed on a metal cylinder 7*a*, and on the elastic layer 7*b* is formed a thin and comparatively hard surface layer 7*c*. A development roller in the form of a belt or a drum may also be used in the present invention. Above the development roller 7, there is disposed a hopper 9 in which toner T is placed. The volume resistivity of the toner T is not less than $10^9$ Ωcm, preferably $10^{14}$ Ωcm or more. The toner T thus has a medium or high resistivity and comprises a resin, such as an epoxy resin, styrene resin and a phenol resin; and a coloring agent, such as carbon black, red iron oxide, ultramarine, and calcium carbonate; and an additive, such as silicone elastomer, silica, ethyl cellulose, and polytetrafluoroethylene. In order to increase the fluidity of the toner T, it is preferable to add a lubricant, such as molybdenum disulfide ($MoS_2$) and talc ($Mg_3Si_4O_{10}(OH)_2$) to the toner T.

In the present invention, a two-component toner for use in the ordinary dry type electrophotographic copying machines can also be employed.

Inside the hopper 9, there is disposed a conductive electrode 10 in close proximity to the development roller 7 and the toner T is in a gap d between the electrode 10 and the development roller 7. It is preferable that the electrode 10 be wear resisting. A switch 11, a current control circuit 12, and a bias power voltage source 13 are connected in series between the electrode 10 and ground.

When the switch 11 is closed, a current flows from the bias voltage power source 13 across the toner layer in the gap d between the electrode 10 and the development roller 7. At this moment, the toner is charged positively in polarity. The thus charged toner is shaped into a toner layer with a predetermined thickness by a regulating member 9*a* formed at an outlet wall of the hopper 9. Therefore, the gap d has to be set greater than a gap t between the regulating member 9*a* and the development roller 7. Should an excess current happen to flow through the electrode 10 for some reason, there is a danger that the toner T may become fused by Joule heat generated by the excess current and may adhere to the surface of the development roller 7 and be dired hard thereon. In order to prevent this, the current control circuit 12 connected between the bias power voltage source 13 and the conductive electrode 10 control the current to the electrode 10 to prevent any such excess current. This control of excess current is considered very important.

When copying is not being performed the development roller 7 remains stationary, and a current may flow across the electrode 10 and the development roller 7. The toner within the gap d may thus be heated so that fusing of the toner may occur by the same process as mentioned above. Therefore, the opening and closing of the switch 11 is controlled in synchromism with the rotation of the development roller 7 in such manner that, when the development roller 7 is not in operation, the switch 11 is opened so that flow of a current across the development roller 7 and the electrode 10 is prevented.

In a development system wherein a bias voltage is applied to the development roller 7 in order to prevent background deposition, a switch 14 is provided for applying a potential from bias source 16. The opening and closing of the switch 14 can be synchronized with the rotation of the development roller 7 in the same manner as mentioned above.

Between the development roller 7 and ground, there are connected a current control circuit 15 and the bias power voltage source 16 in series. The function of the current control circuit 15 is the same as that for the current control circuit 12. It is preferable that the current which flows across the gap d be as small as possible. According to some experiments conducted by the inventors of the present invention, the toner was not fused when an electric current up to 0.5 mA was applied across the gap d when the peripheral speed of the development roller 7 was 200 mm/sec., and the gap d was 0.05 mm, and the potential difference between the electrode 10 and the development roller 7 as 200 V, and the volume resistivity of the toner was in the range of from $10^{14}$ to $10^{16}$ Ωcm.

The toner which has been charged positively in polarity by the electrode 10 is shaped into a toner layer with a predetermined thickness by the regulating member 9 and comes in contact with the photoconductive material 5 so that a latent electrostatic image formed on the photoconductive material 5 is developed by the toner. The toner remaining on the development roller 7 is then mixed with the toner T placed in the hopper 9.

Of course, the voltage of the bias voltage power source 16 is set as high as or slightly higher than the residual potential on the photoconductive material 5. Furthermore, in accordance with the qualities on the original image, the electric current from the bias voltage power source 13 maybe adjusted so that the magnitude of charge applied to the toner may appropriately be changed, whereby an appropriately developed image can be obtained. In this case, the voltage of the bias voltage power source 16 can be varied in accordance with the above-mentioned adjustment of the electric current from the bias voltage power source 13, whereby background deposition or insufficient development can be prevented.

Figure 4:
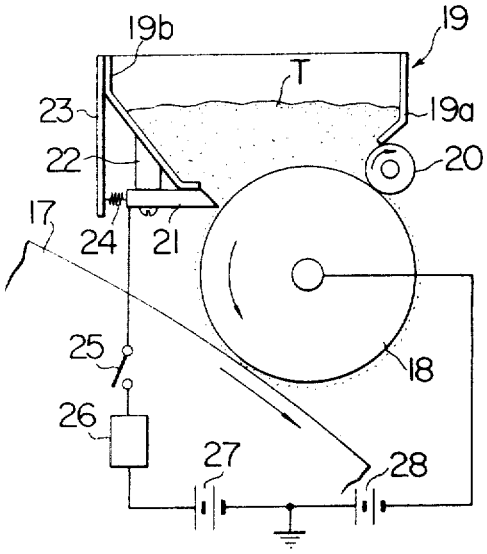
FIG. 4 is a schematic sectional side view of another embodiment of a development apparatus according to the invention.

Referring to FIG. 4, there is shown another embodiment of a development apparatus of the invention, in which the electrode 10 and the regulating member 9a in FIG. 2 are united for simplification. In FIG. 4, reference numeral 17 represents a photoconductive recording member having a latent electrostatic image thereon which is moved in the direction of the arrow. In close proximity to the photoconductive recording member 17, there is disposed a development roller 18 which is rotated counterclockwise. Since the development roller 18 is substantially the same as the development roller 7 shown in FIG. 2, a detailed explanation thereof is omitted here. Above the development roller 18, there is disposed a hopper 19 for holding the toner T therein. In a gap between a back wall 19a of the hopper 19 and the development roller 18, through which the toner is returned into the hopper 19 after development, there is disposed a roller 20 which is in light contact with the peripheral surface of the development roller 18 and is rotated by friction between the development roller 18 and the roller 20. The roller 20 can be driven by other driving means so as to be rotated at the same peripheral speed as that of the development roller 18. The roller 20 serves to prevent the toner from falling from the back wall 19a of the hopper 19. Furthermore, at a lower end portion of a front wall 19b of the hopper 19 which forms an outlet for the toner, there is attached movably a toner layer regulating member 21. The toner layer regulating member 21 is shaped like a plate having an acute tip and is supported on a support member 22. The rear end of the regulating member 21 is urged to the right by an elastic member 24, such as a spring, disposed between the regulating member 21 and a 23 plate fixed to the hopper 19, so that the tip of the regulating member 21 is urged in the direction of the surface of the development roller 18.

The regulating member 21 also serves as a conductive electrode for applying a charge to the toner. A switch 25, a current control circuit 26, a bias voltage power source 27 are connected in series between the regulating member 21 and ground. Since the respective functions of these members are the same as those in FIG. 2, a detailed explanation thereof is not repeated here. The toner deposited on the development roller 18 is carried from the hopper 19 and, while it is passed by the regulating member 21, a toner layer with a predetermined thickness is formed on the development roller 18 and, at the same time, a positive charge is given to the toner. In order to prevent background deposition of the toner during development caused by a residual potential on the surface of the photoconductive member 17, a bias voltage, whose polarity is the same as that of the residual potential on the photoconductive member 17 and which is almost the same in magnitude as the residual potential, is applied to the development roller 18 by a bias voltage power source 28.

The inventors of the present invention conducted the following experiment using the development apparatus shown in FIG. 4. By use of a toner having approximately $10^{16}$ Ωcm of volume resistivity, an approximately 40 μm thick toner layer was formed on the development roller 18 by the regulating member 21. The development roller 18 was made of a conductive silicone rubber whose hardness was 45 degrees and whose volume resistivity was not more than $10^5$ Ωcm. The development roller 18 was rotated at a 200 mm/sec peripheral speed and an electric current up to 0.5 mA, normally at about 0.05 mA, was applied across the toner layer from the regulating member 21 to the development roller 18. As a result of this experiment, fusing of the toner on the development roller 18 and the regulating member 21 did not occur.

Figure 5:
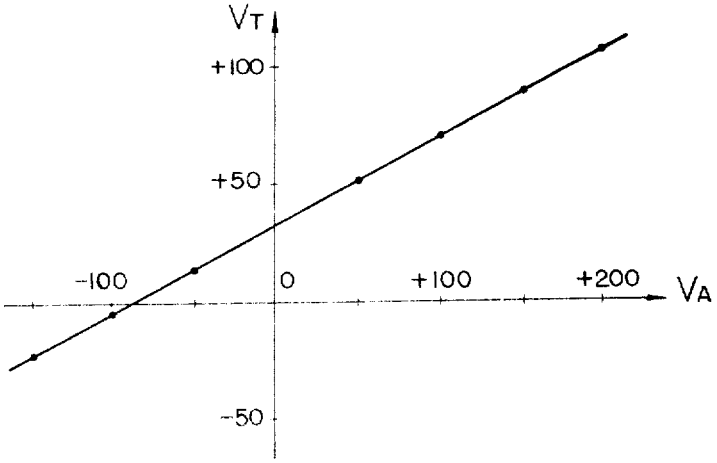
FIG. 5 is a graph showing a relationship between the charging potential $V_T$ of a toner and a potential difference $V_A$ between the potential of a conductive electrode and that of a development roller.

Referring to FIG. 5, there is shown a relationship between a charged potential $V_T$ of the toner and a potential difference $V_A$ between a potential applied to the electrode (i.e., the regulating member 21) and a potential applied to the development roller 18. As can be seen from the relationship shown in FIG. 5, the charged potential $V_T$ of the toner, that is the charge density of the toner, can be selectively controlled by the potential difference $V_A$. Therefore, by changing approximately the potential applied to the electrode (i.e., the regulating member 21) or the potential applied to the development roller 18 in accordance with the kind of an original to be copied, an appropriate image can be obtained. For example, in the case of an original with low contrast, the bias voltage power source 13 in FIG. 2 or the bias voltage power source 27 is designed to be variable, and by pushing a contrast button (not shown) manually or by automatically detecting the contrast during an exposure step, the potential applied to the electrode 10 or 21 is increased in comparison with the normal potential so that the charged potential of the toner is heightened, whereby a good copy can be obtained. At the same time, the bias voltage applied to the development rollers 7 or 18 may be increased slightly in cooperation with the increase of the charged potential of the toner. This latter step is considered important since the toner is apt to be desposited on the background of the copy when the potential of the toner is increased. In order to prevent such background deposition, the bias voltage applied to the development rollers 7 or 18 is thus also increased cooperatively with any increase in potential to the electrode 7 or 18.

In the development apparatus as shown in FIG. 4, in which the toner layer regulating member 21 also serves as the electrode, even if some toner particles in the toner layer are charged to the same polarity as that of the latent electrostatic image, such toner particles are attracted electrostatically to the regulating member 21 when they pass the regulating member 21. Therefore, the abovementioned background deposition is prevented in the development apparatus as shown in FIG. 4.

Figure 6:
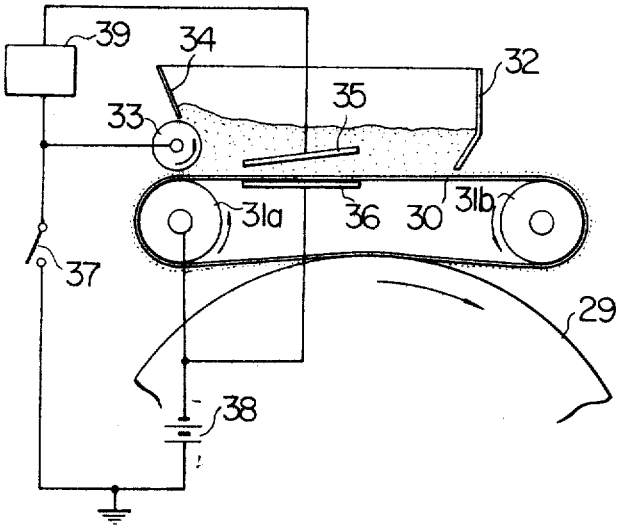
FIG. 6 is a schematic sectional side view of a further embodiment of a development apparatus according to the invention.

Referring to FIG. 6, there is shown a further embodiment of a development apparatus of the invention. In FIG. 6, reference numeral 29 represents a photoconductor drum, and reference numeral 30 represents a development belt for applying toner to the photoconductor drum 29. The belt 30 is trained around a pair of rollers 31*a* and 31*b* and transports a toner layer when the pair of rollers 31*a* and 31*b* are rotated in the direction of the respective arrows. The development belt 30 is made of a material suitable for holding the toner thereon, such as a silicone rubber, a chloroprene rubber and a polyurethane rubber which are conductive elastomers having a $10^5$ Ω cm or less volume resistivity. Above the development belt 30, there is disposed a hopper 32. At a toner outlet of the hopper 32, there is rotatably mounted a reverse roller 33 which regulates the toner layer of toner on development belt 30 and serves as an electrode as well. The reverse roller 33 is located in close proximity to the development belt 30 and is rotated in a direction opposite to the rotation of the development belt 30. A blade member 34 is disposed in pressure contact with the surface of the reverse roller 33 in order to remove continuously the toner deposited on the reverse roller 33. It is preferable that the blade member 34 be made of an insulating material which does not scratch the reverse roller 33, such as polyurethane. Inside the hopper 32, there is disposed an electrode 35 which is slanted in such manner as to slope toward to the development belt 30 as viewed from the travelling direction of the development belt 30. On the back side of the development belt 30 right under the electrode 35, there is disposed a counter electrode 36 in contact with the development belt 30. The electrode 35 is arranged slantingly in such manner that the toner in the hopper 32 can easily enter between the electrode 35 and the development belt 30. The reason why the electrode 35 is used in addition to the reverse roller 33 is to assure the toner is charged sufficiently. Both the reverse roller 33 and the electrode 35 are grounded through a switch 37, while the roller 31*a* and the counter electrode 36 are connected to the negative side of a bias voltage power source 38. By this arrangement, a potential difference is set between the reverse roller 33 and the development belt 30, and between the electrode 35 and the development belt 30, so that the toner, which passes between the reverse roller 33 and the development belt 30, is to an appropriate level. In other words, it is not always necessary to apply a bias voltage to the electrode 35, but what is essential is that there is a potential difference between the electrode 35 including the reverse roller 33 and the development belt 30. A current control circuit 39 is connected between the electrode 35 and ground. However, since the function of the current control circuit 39 is the same as that of the above-mentioned current control circuits, a detailed explanation thereof is omitted here.

Figure 7:
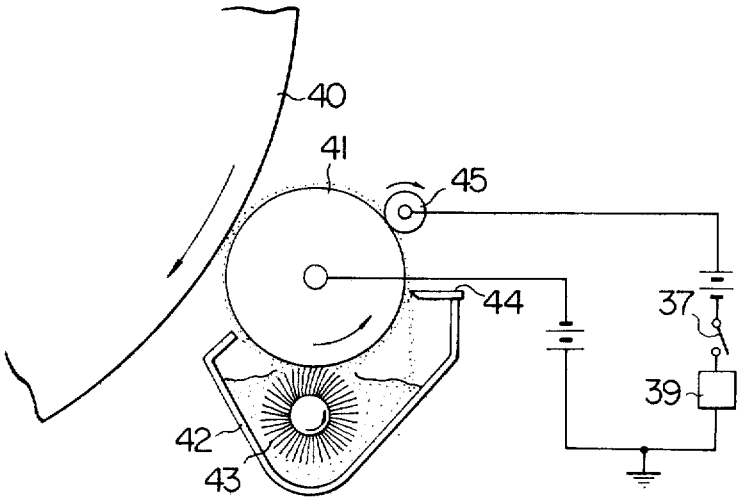
FIG. 7 is a schematic sectional side view of a further embodiment of a development apparatus according to the invention.

Referring to FIG. 7, there is shown a further embodiment of a development apparatus of the invention. In FIG. 7, a development roller 41 is disposed in close proximity to a photoconductor drum 40 at a position where the surface of the photoconductor drum 40 is moved towards in the direction of the arrow, and the development roller 41 is rotated in the direction of the arrow. Under the development roller 41, there is disposed a container 42 for toner replenishment, in which a brush member 43 is disposed. The brush member 43 is rotated in the direction of the arrow in order to supply toner to the development roller 41. Excessive toner replenished to the development roller 41 by the brush member 43 is shaped into a toner layer with a predetermined thickness on the development roller 41 by a toner layer regulating member 44 disposed at an outlet portion of the container 42. In front of the toner layer regulating member 44, viewed from the top of the development roller 41, a roller electrode 45 is disposed in light contact with the peripheral surface of the roller 41 in such manner so as to be driven by the development roller 41. A bias voltage is applied to the roller electrode 45 and a potential difference is set between the development roller 41 and roller electrode 45 so that the toner, which passes between the roller 41 and electrode 45, is charged to an appropriate level. To the development roller 41 is applied a potential which is almost the same as a residual potential on the photoconductor drum 40 and whose polarity is the same as that of residual potential. As in FIG. 7, reference numeral 39 illustrates a current control circuit.

Figure 8:
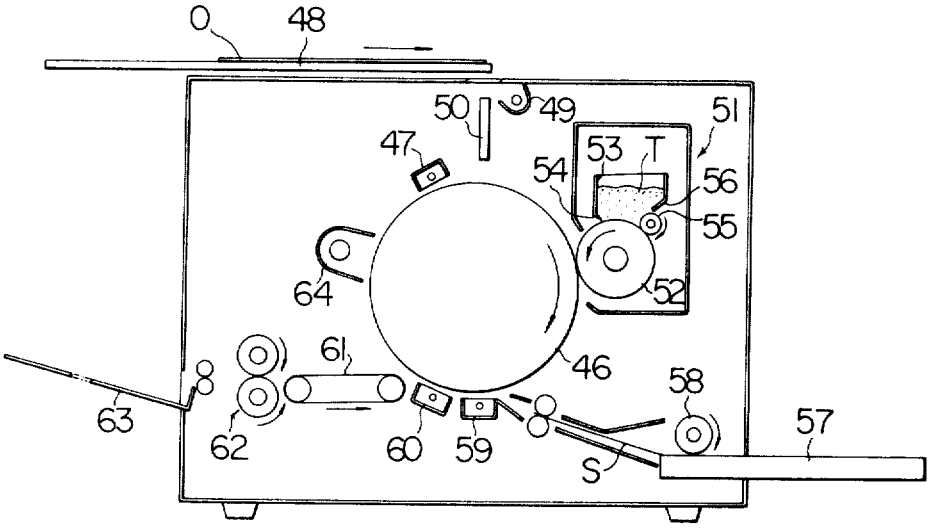
FIG. 8 is a schematic sectional side view of an electrophotographic copying machine in which one embodiment of a development apparatus according to the invention is employed.

FIG. 8 shows an electrophotographic copying machine in which an embodiment of the present invention is employed. The copying machine shown in FIG. 8 is of a type capable of obtaining one copy by two rotations of the photoconductor drum 46, and a feature of the copying machine is that the cleaning of the photoconductor drum 46 is made at a development station of the copying machine in order to make the machine compact and inexpensive. The drum 46 is rotated in the direction of the arrow, around which each process unit is arranged.

First, the first rotation of the drum 46 will be described. By a copying start signal, a charging apparatus 47 is actuated so that the surface of the drum 46 is charged uniformly and, at the same time, an original platen 48 starts to move in the direction of the arrow and an original O placed on the platen 48 is illuminated by a illuminating lamp 49. The thus obtained light image of the original O is transmitted to the drum 46 by an image transmitting optical fiber means 50 so that a latent electrostatic image is formed on the drum 46. On the right side of the drum 46, there is disposed a cleaning and development apparatus 51 which is designed so as to perform development during the first rotation of the drum 46 and cleaning of the drum 46 during the second rotation of the drum 46. A development roller 52, which is rotated in the direction of the arrow so that its peripheral surface moves at the same speed as or at a higher speed than that of the drum 46, is disposed in light contact with or in close proximity to the drum 46. A hopper 53 is situated above the development roller 52. Near an outlet of the hopper 53 for discharging toner T, there is disposed an electrode 54 to which a bias voltage is applied and which also serves as a toner layer regulating member. Furthermore, near an inlet of the hopper 53 for receiving the toner T, there is disposed a roller 55 which is rotated in light contact with the roller 52 so that the toner T is prevented from falling out from the hopper 53. A blade member 56 is disposed in pressure contact with the roller 55 in order to remove the toner T deposited on the roller 55. The roller 52 is made of a conductive material capable of holding the toner thereon by the attraction exerted between the conductive material and the toner T.

During development, a bias voltage, which is opposite in polarity to that of the toner T, is applied to the development roller 52 for preventing background deposition of the toner T. At an image transfer station, the thus developed toner image is brought into close contact with a transfer sheet S, which is fed from a transfer sheet cassette 57 by a sheet feed roller 58, and a corona charge which is opposite in polarity to that of the toner is applied to the transfer sheet S by a corona charge image transfer apparatus 59, so that the toner image is electrostatically transferred to the sheet S. In front of the corona charge image transfer apparatus 59, viewed from the rotating direction of the drum 46, there is disposed a corona sheet separation apparatus 60 comprising an a.c. corona charger, which neutralizes the charge that has been applied to the back side of the sheet S during the image transfer process, reducing the electrostatic attraction exerted between the transfer sheet S and the drum 46, so that the sheet S can be easily separated from the drum 46. The thus separated sheet S is transported to an image flexing apparatus 62 by a transfer belt 61. As the image fixing apparatus 62, the conventional heat roller image fixing system, pressure image fixing system, or radiant heat fixing system can be employed. The fixed toner image bearing transfer sheet S is discharged face-up onto a sheet discharge tray 63. In the meantime, residual charges on the drum 46 are neutralized by a neutralizing apparatus 64. As the neutralizing apparatus 64, only a neutralizing system by light illumination is shown in FIG. 8. However, an a.c. corona charging system, an opposite polarity corona charging system, or neutralizing system combining the aforementioned two systems can be used as well. Thus, the first rotation of the drum 46 is completed. The drum 46 continues to be rotated, entering into the second rotation. At this stage, the charging apparatus 47, the lamp 49, the corona charge image transfer apparatus 59, and the sheet separation apparatus 60 are made inoperative. Since the toner deposited on the drum 46 is discharged sufficiently by the neutralizing apparatus 64, the electrostatic attraction of the toner to the drum 46 is weakened and accordingly the toner is electrostatically attracted from the drum 46 to the development roller 52 to which a bias voltage whose polarity is opposite to that of the toner is now applied. The toner removed by the roller 52 can be used again during the succeeding development process.

After the drum 46 is neutralized by the neutralizing apparatus 64, the second rotation of the drum 46 is completed, but the drum 46 can be designed so as to be rotated once again for neutralizing the drum 46 when a continuous copying or a single copying has been finished.

Figure 9:
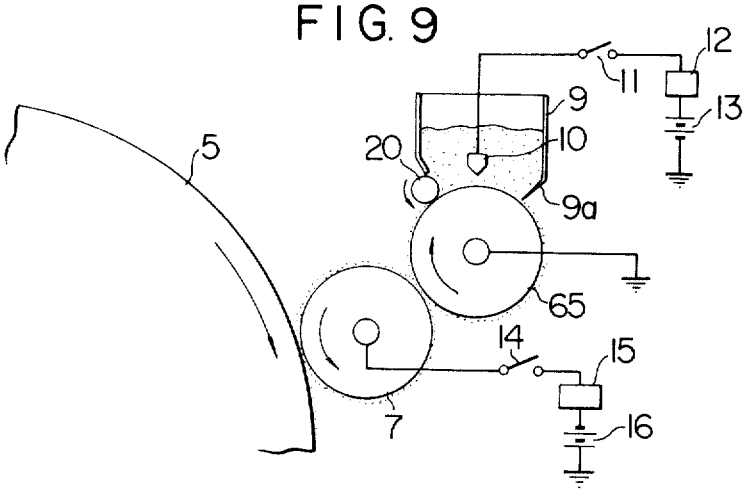
FIG. 9 is a schematic sectional side view of a further embodiment of a development apparatus of the invention.

In the above-mentioned embodiments, an electric charge with a predetermined polarity is applied to the toner on the development roller or other development member which directly supplies toner to the photoconductor drum or the recording member. However, this charging can be done by a member which supplies toner to the development belt as shown in FIG. 9. In FIG. 9, the same reference numerals as in the above-mentioned embodiments represent members having substantially the same functions as those in the above-mentioned embodiments. Therefore, their detailed explanation is omitted here. In close proximity to the photoconductive material 5, there is disposed a development roller 7, and in close vicinity to or in light contact with the roller 7, there is disposed a toner feed roller 65 for feeding toner to the roller 7. The toner feed roller 65 is made of an material identical to that of the roller 7. Furthermore, the toner feed roller 65 is designed so as to be rotated at almost the same peripheral speed as that of the roller 7 with the facing surfaces of the two rollers moving in the same direction in order that the toner feed roller 65 can surely supply toner to the roller 7. The bias voltage is applied to the roller 7 and this makes it easy to transfer toner from the roller 65 to the roller 7. Above the roller 65, there is situated a hopper 9 for supplying toner to the roller 65. The toner is charged by the electrode 10 disposed in the hopper 9 and is carried from the hopper 9 in the shape of a toner layer formed into a predetermined thickness by the toner layer regulating member 9*a*.

At a toner inlet to the hopper 9, there is disposed the roller 20 for preventing toner from falling out from the hopper 9. In this case, a sufficient potential difference for charging the toner can be formed between the roller 65 and the electrode 10 just by grounding the roller 65 without applying a bias voltage to the roller 65. In the present invention, a magnetic toner can be employed as well.

Figure 10:
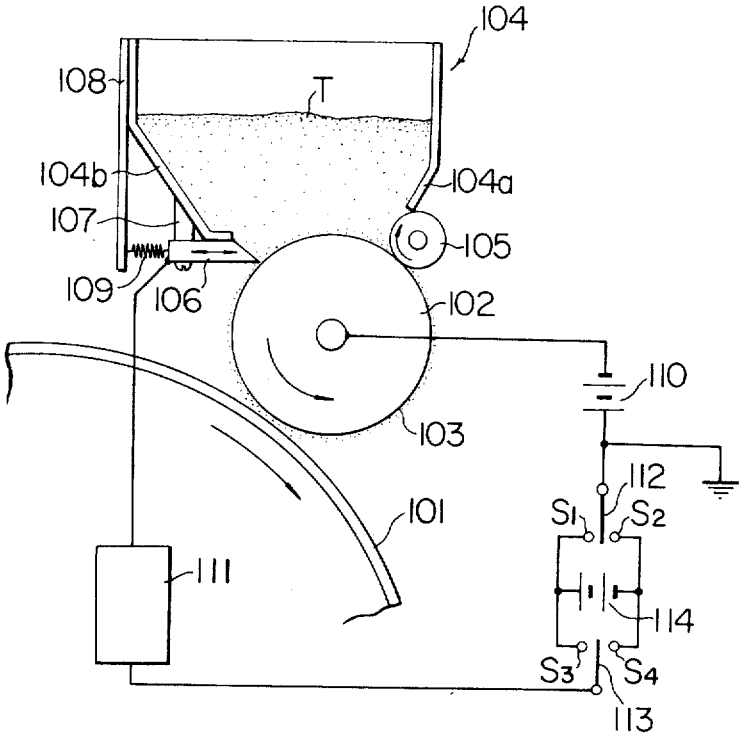
FIG. 10 is a schematic sectional side view of a further embodiment of a development apparatus of the invention.

FIG. 10 shows a further embodiment of the present invention. In FIG. 10, reference numeral 101 represents a recording material on which a latent electrostatic image is formed and which is rotated in the direction of the arrow. As the recording material 101, a photoconductive material comprising an inorganic photoconductive layer such as sulfur, zinc oxide, cadmium sulfide, and selenium or an organic photoconductive layer such as anthracene and polyvinylcarbazole, formed on a substrate or having additionally a transparent insulating layer on the photoconductive layer, or dielectrics are used.

Figure 11:
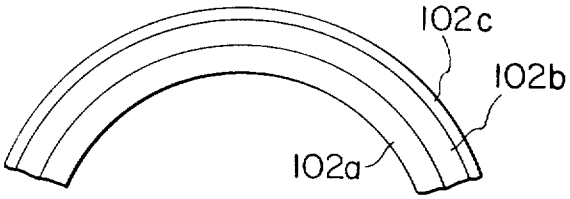
FIG. 11 is a schematic sectional side view of a development roller to be employed in the invention.

The recording material 101 can be shaped in the form of a drum or a belt. In this embodiment, a drum-shaped recording material is employed. In close proximity to the recording material 101, there is disposed a development roller 102 which is rotated counterclockwise. It is necessary that the volume resistivity of the development roller 102 be not more than $10^8$ Ωcm, preferably $10^5$ Ωcm or less from the viewpoint of a bias voltage application to the roller 102. As a material of the roller 102, metals can be employed, but silicone rubber, chloroprene rubber and polyurethane rubber, which are made conductive by addition of carbon thereto, are preferable since toner will adhere to rollers formed of such materials and are thus convenient for transporting toner. Furthermore, these materials are appropriately elastic and a toner layer 103 with a predetermined thickness can be easily formed thereon. The roller 102 can be made in one layer selected from the abovementioned materials, or in multi-layers as shown in FIG. 11, in which an elastic layer **102*b* comprising one of the above-mentioned elastic materials is formed on a metal core 102*a*, and on the elastic layer 102*b*, there is formed a thin and comparatively hard surface layer 102*c*. In the present invention, instead of the roller 102, a belt-shaped member can be employed equally as well. Above the roller 102, there is disposed a hopper 104 for holding toner T therein. The hopper 104, a back wall 104*a* and a front wall 104*b* of the hopper 104, a roller 105, a toner layer regulating member 106, and a support member 107 are substantially the same as the hopper 19, the back wall 19*a* and the front wall 19*b* of the hopper 19, the roller 20, the toner layer regulating member 21, and the support member 22 in FIG. 4**, respectively.

As in the embodiment of FIG. 4, the toner layer regulating member 106 serves as a conductive electrode for applying a charge to the toner T. Namely, when a bias voltage is applied to the member 106 by an outer power source, an electric current flows across the toner T so that the toner T is charged in to a predetermined polarity. As a material for use in the member 106 having the above-mentioned two functions, a wear-proof material, such as Al, Fe, Cu, Zn and other materials, is preferable since it is always in contact with the toner T. The development roller is connected to a development bias voltage power source 110 whose voltate is set almost at the same voltage of the residual potential on the recording material 101. A current control circuit 111 is connected between the member 106 and earth ground and, between the current control circuit 111 and ground, two switches 112, 113 are connected in series so as to be selectively connected to contacts $S_1$ or, $S_2$ and $S_3$ or, $S_4$ respectively. The contacts $S_1$ and $S_3$ are connected to the positive side of a toner charging polarity control power source 114 disposed between the switches 112 and 113, and the contacts $S_2$ and $S_4$ are connected to the negative side of the power source 114. The current control circuit 111 has the same function as that of the circuit 12 in FIG. 2.

When copying is not being performed the switch 113 is connected to neither the contact $S_3$ nor the contact $S_4$. Additionally, the switch 112 may not be connected to either of its contacts. When the copying operation is not being performed, normally the development roller 102 remains stationary. If an electric current continuously flows across the member 106 under this condition, the toner adjacent the member 106 is heated. As a result, the toner may adhere to the member 106 or the roller 102. In order to obviate such a disadvantage, at least the switch 113 has to be opened when the copying operation is not performed. Of course, the switch 113 can be designed so as to open cooperatively with the stopping of the rotation of the development roller 102. In order to break an electric current to the member 106, a switch can be inserted in the circuit. Obviously, the application of a bias voltage to the roller 102 can be controlled in the same manner as in the application of a voltage to the toner layer regulating member 106.

The operation of the present embodiment will be described with respect to the case where a latent electrostatic image whose polarity is negative is formed on the recording material 101 and where the polarity of an original image and that of a copy image are not reversed, namely, when the original image is positive image, the copy image is developed positive and, when the original image is negative, the copy image is developed negative.

Figure 12:
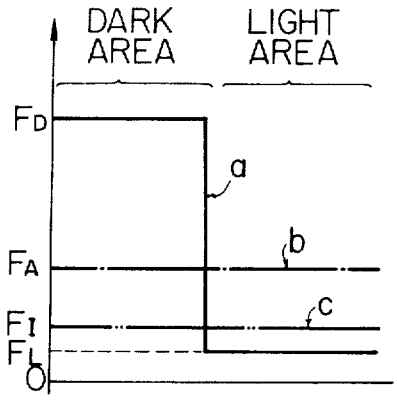
FIG. 12 shows the principle of a normal development in the invention.

In this case, the switch 112 is connected to the contacts $S_2$, and the switch 113 is connected to the contact, whereby a positive voltage is applied to the member 106 so that the toner is charged positive when it passes under the member 106. The development of a latent electrostatic image is made by this toner, and a principle of the development will be described by referring to FIG. 12. In FIG. 12, reference character a represents an attraction of the latent electrostatic image for the toner. The attraction $F_D$ for the toner in a dark area is greater than an attraction $F_L$ for the toner in a light area. Reference character b represents an attraction $F_A$ for the toner generated by a bias voltage applied to the roller 102, and reference character c an image force $F_I$ exerted between the recording material 101 and the toner due to an electric charge of the toner. In general, the image force $F_I$ is represented by the following equation.

$$F_I = \frac{k-1}{k+1} \cdot \frac{1}{4\pi\epsilon_O} \cdot \frac{q^2}{4r^2}$$

where k is the dielectric constant of the recording material, and $\epsilon_0$ is the dielectric constant of vacuum, and r is the radius of the toner particle, and q is the charge of the toner particle. Namely, when the toner is charged, it is always attracted to the recording material.

Referring to FIG. 12, when a relationship of $F_D+F_I>F_A>F_I+F_L$ is satisfied in the dark area of the recording material 101, the toner is deposited in the dark area while, in the light area, no toner is deposited, so that an image with the same polarity as that of the original image can be obtained. This also applies to the case where a latent electrostatic image is charged positive.

The case where the latent image is formed by negative charges on the recording material and the polarity of a copy image is to be reversed with respect to the polarity of an original image will be described next. Namely, it is the case where a positive original is developed negative and a negative original is developed positive. In this case, the switch 112 is set on the contact $S_1$ and the swtich 113 is set on the contact $S_4$, whereby a negative voltage is applied to the toner layer regulating member 106 so that the toner is charged negative. When development is made under this condition, a reversed image is developed. By referring to FIG. 13, the relationship of the attractions of the toner, the development roller 102 and the latent electrostatic image will be described. It must be noted here that the voltage of a toner charging polarity control power source 114 has to be set lower than the voltage of the development bias voltage power source 110. In the dark area of the recording material, there is a relationship of $F_D'>F_A'$, and in the light area, there is a relationship of $-F_I>F_L'$, so that the negatively charged toner is not deposited in the dark area, but it is deposited only in the light area. Namely, $F_I$ acts as an attraction for the toner and is the same in magnitude as $F_I$ in FIG. 12. $F_L'$ and $F_A'$, and $F_D'$ also act as the attractions for the toner.

Figure 13:
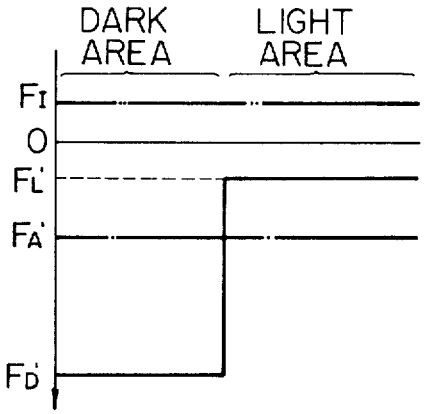
FIG. 13 shows the principle of a reverse development in the invention.
Figure 14:
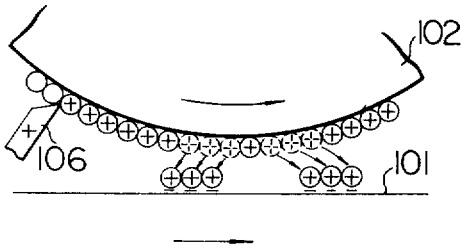
FIG. 14 shows a development model of FIG. 12.
Figure 15:
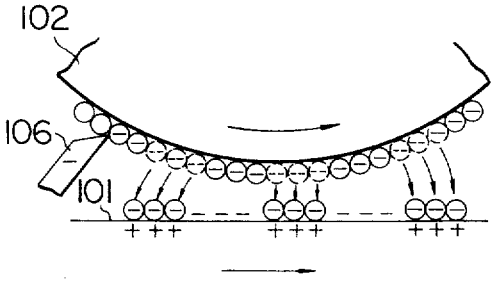
FIG. 15 shows a development model of FIG. 13.

The development in which the toner is attracted to the recording material 101 will be described in more detail by use of development models in FIGS. 14 and 15. A development model corresponding to FIG. 12 is illustrated in FIG. 14, in which the toner, which has been charged positively by the toner layer regulating member 106, is deposited on the surface of the roller 102, and the positively charged toner is attracted to a negatively charged electrostatic image formed on the recording material 101. In FIG. 15, a development model corresponding to FIG. 13 is illustrated, in which the toner, which has been charged negatively by the member 106, is deposited on the surface of the roller 102, and negatively charged toner is attracted to the areas except the area where negatively charged electrostatic images are formed, by an image force generated in such area except the latent electrostatic images, whereby a reverse development is made.

Figure 16:
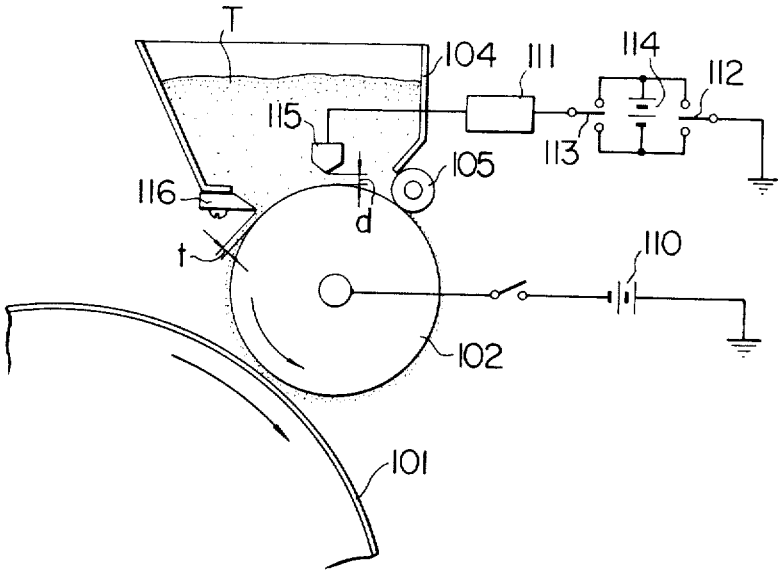
FIG. 16 is a schematic sectional side view of a further embodiment of a development apparatus of the invention.
Figure 17:
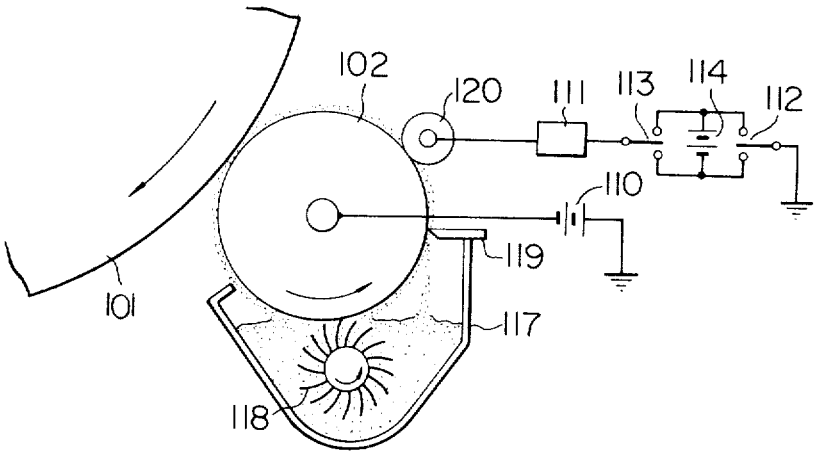
FIG. 17 is a schematic sectional side view of a further embodiment of a development apparatus of the invention.

In the above-mentioned embodiment, the member 106 serves as an electrode for applying charges to the toner. However, as shown in FIGS. 16 and 17, the electrode for applying charges to the toner can be disposed separately from the toner layer regulating member 106. In FIGS. 16 and 17, the members having the same functions as those of the members in FIG. 10 are given the same reference numerals, respectively, and a detailed description thereof is omitted here.

Referring to FIG. 16, inside the hopper 104, a conductive electrode 115 is disposed with a gap d from the development roller 102 and is buried in the toner T. Preferably the electrode 115 is made of a wear resisting material, or it can be made of the same material as that of the member 106. There is set a gap t between the member 116 and the roller 102. The gap d is set a little greater than the gap t.

Referring to FIG. 17, there is shown a further embodiment of a development apparatus according to the invention, in which an electrode is arranged outside the hopper. On the lower right side of the photoconductor drum 101, where is disposed the roller 102 which is rotated in the direction of the arrow. Under the roller 102, there is disposed a container 117 for holding the toner therein and replenishing the toner therefrom. Inside the container 117, there is disposed a rotatable brush member 118 for supplying the toner ro the roller 102. Excessive toner supplied to the roller 102 by the brush member 118 is shaped into a toner layer with a predetermined thickness on the roller 102 by a toner layer regulating member 119. In front of the member 119, viewed from the rotating direction of the roller 102, a roller electrode 120 is arranged in light contact with the peripheral surface of the roller 102. To the roller electrode 120 is connected a power source circuit which is exactly the same as the circuit connected to the toner regulating member 106 shown in FIG. 10 and, by operating the switches 112 or 113, a negative image and a positive image can be selectively obtained. A bias voltage which is almost the same as that of a residual potential on the drum 101 is applied to the roller 102 by the development bias voltage power source 110.

In the above-mentioned example, the toner is charged in a predetermined polarity on the development roller by the electrode. However, an embodiment can be employed as well, in which at least one toner feed roller is disposed between the hopper and the development roller, and the toner is charged by the toner feed roller, and the thus charged toner is supplied to the development roller.

Furthermore, by arranging a plurality of the above-mentioned development apparatus of the invention, a high speed development can be attained. Moreover, the toner is not necessarily limited to non-magnetic toner, but a magnetic toner can be employed. In this case, a magnetic roller is employed as the development roller.

What is claimed is:

1. A development apparatus for developing a latent electrostatic image formed on a photoconductor, comprising:

container means for holding a one-component type developer and having an outlet for discharging said developer therefrom, said developer having a volume resistivity of no less than about $10^9$ ohm-cm;

developer supplying means, having an endless conductive surface of a material having a volume resistivity no greater than about $10^8$ ohm-cm, for supplying said developer discharged from said container means to said photoconductor;

means including a conductive element located at said outlet and held in contact with said developer for forming a toner layer with a predetermined thickness on said endless conductive surface when said developer is supplied from said container means to said photoconductor by said developer supplying means; and power source means connected to said conductive element for providing a voltage of a predetermined polarity thereto for charging said developer to a predetermined polarity.

2. An apparatus as in claim 1 further comprising current control means connected between said conductive element and said power source means for controlling the current to said conductive element.

3. An apparatus as in claim 1 wherein said developer supplying means comprises a roller and further comprising switch means for opening and closing the connection between said conductive element and said power source means in response to the rotation of said roller.

4. An apparatus as in claim 1 further comprising means for applying a bias voltage to said endless conductive surface.

5. An apparatus as in claim 4 further comprising means for selectively increasing the voltage of said power source means and said bias voltage means.

6. An apparatus as in claim 1, further comprising conductive electrode means formed by a first electrode disposed above said endless conductive surface and a second electrode disposed beneath and in contact with said endless conductive surface, one of said first and second electrode being connected to said power source means.

7. An apparatus as in claim 1 further comprising switch means for reversing the predetermined polarity of said power source means applied to said conductive element.

8. An apparatus as in claim 1 wherein the volume resisitivity of said material is not more than $10^5$ ohm-cm and the volume resistivity of said developer is greater than about $10^{14}$ ohm-cm.

9. An apparatus for developing a latent electrostatic image formed on a charged photoconductor by exposure of an original, comprising a supply of developer having a volume resistivity of at least about $10^9$ ohm-cm; transport means for bringing said developer into contact with said latent image; and charging means including a conductive electrode connected to a source of potential for applying a voltage to said developer for causing it to be attracted to selected portions of said latent image, said charging means including selection means for changing the polarity of the potential connected to said electrode for selectively applying a voltage to said electrode suitable for developing a positive or negative image of the original, as desired.

10. An apparatus as in claim 9, said transport means including an endless surface having a volume resistivity no greater than $10^8$ ohm-cm, said electrode being spaced from a portion of said surface to provide a gap for applying a potential to the developer within said gap.

11. An apparatus as in claim 10, said electrode being positioned adjacent to where said developer leaves its supply so that the size of said gap controls the thickness of developer on said surface.

12. An apparatus as in claim 10, including bias means for applying a potential to said endless surface whereby the voltage level of said charged developer depends on the potential applied to both said electrode and said endless surface.

13. An apparatus as in claim 12, including means for adjusting the voltage level of said bias means cooperatively with that of said charging means.

14. An apparatus as in claim 9, further including means for limiting the level of current applied to said electrode.

15. An apparatus as in claim 9, said selection means including a switch connecting either a positive terminal or a negative terminal of a power source to said electrode while connecting the other of said terminals to ground.

16. A developement apparatus for developing a latent electrostatic image formed on a photoconductor, comprising:

container means for holding a one-component type developer and having an outlet for discharging said developer therefrom, said developer having a volume resistivity of no less than about $10^9$ ohm-cm;

developer supplying means, having an endless conductive surface of a material having a volume resistivity no greater than about $10^8$ ohm-cm, for supplying said developer discharged from said container means to said photoconductor;

doctor means for forming a toner layer with a predetermined thickness on said endless conductive surface when said developer is supplied from said container means to said photoconductor by said developer supplying means;

power source means for providing a voltage of a predetermined polarity; and conductive electrode means connected to said power source means for charging said developer to a predetermined polarity; said conductive electrode means being disposed within said container means so as to contact said developer therewithin.

17. An apparatus as in claim 16, said container means serving to hold a supply of developer in contact with the endless surface of said developer supply means, said doctor means including an element located at the outlet of said container, said element being spaced from said endless surface a distance less than the spacing between said endless surface and said conductive electrode means disposed within said container means.

18. An apparatus as in claim 16 further comprising current control means connected between said conductive electrode means and said power source means for controlling the current to said electrode means.

19. An apparatus as in claim 16 wherein said developer supplying means comprises a roller and further comprising switch means for opening and closing the connection between said conductive electrode means and said power source means in response to the rotation of said roller.

20. An apparatus as in claim 16 further comprising means for applying a bias voltage to said endless conductive surface.

21. An apparatus as in claim 20, further comprising means for selectively increasing the voltage of said power source means and said bias voltage means.

22. An apparatus as in claim 16 wherein said conductive electrode means comprises a first electrode disposed above said endless conductive surface and a second electrode disposed beneath and in contact with said endless surface, one of said first and second electrodes being connected to said power supply means.

23. An apparatus as in claim 16 further comprising switch means for reversing the predetermined polarity of said power source means applied to said conductive electrode means.

24. An apparatus as in claim 16 wherein the volume resistivity of said material is not more than $10^5$ ohm-cm and the volume resistivity of said developer is greater than about $10^{14}$ ohm-cm.

25. An apparatus as in claim 1 or 16 wherein said developer supplying means comprises a roller comprising a metal core, an elastic layer on said metal core, and a thin, comparatively hard surface layer on said elastic layer.

* * * * *